US006258746B1

(12) United States Patent
Mehta et al.

(10) Patent No.: US 6,258,746 B1
(45) Date of Patent: Jul. 10, 2001

(54) THERMALLY IMAGABLE BUSINESS RECORD AND METHOD OF DESENSITIZING A THERMALLY IMAGABLE SURFACE

(75) Inventors: Rajendra Mehta, Dayton; Gary Doll, Englewood; Mark Dotson, Dayton; A. Dale Lakes, Dayton; Rick L. Shields, Dayton, all of OH (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 09/456,337

(22) Filed: Dec. 8, 1999

Related U.S. Application Data

(62) Division of application No. 09/061,454, filed on Apr. 16, 1998, now Pat. No. 6,015,589, which is a division of application No. 08/794,476, filed on Feb. 4, 1997, now Pat. No. 5,810,397, which is a continuation-in-part of application No. 08/235,543, filed on Apr. 29, 1994, now Pat. No. 5,984,363, which is a continuation-in-part of application No. 08/055,576, filed on May 3, 1993, now abandoned.

(51) Int. Cl.[7] ..... B41M 5/30; B41M 5/34
(52) U.S. Cl. ..... 503/204; 503/205; 503/206
(58) Field of Search ..... 503/204, 205, 503/206

(56) References Cited

U.S. PATENT DOCUMENTS

| | | |
|---|---|---|
| 2,235,791 | 3/1941 | Wohlers . |
| 2,374,862 | 5/1945 | Green . |
| 3,858,705 | 1/1975 | Reitano . |
| 3,924,049 | 12/1975 | Truitt et al. . |
| 4,109,047 | 8/1978 | Fredrickson . |
| 4,223,918 | 9/1980 | Smoczynski . |
| 4,334,771 | 6/1982 | Ryan, Jr. . |
| 4,427,985 | 1/1984 | Kikuchi et al. . |
| 4,457,540 | 7/1984 | Hohne . |
| 4,505,497 | 3/1985 | Katzman . |
| 4,577,204 | 3/1986 | Shibata et al. . |
| 4,627,641 | 12/1986 | Kawagucki . |
| 4,638,340 | 1/1987 | Iiyama et al. . |

(List continued on next page.)

FOREIGN PATENT DOCUMENTS

| | | |
|---|---|---|
| 2173012 | 10/1986 | (GB) . |
| 58-36485 | 3/1983 | (JP) . |
| 62-39277 | 2/1987 | (JP) . |
| 2-80287 | 3/1990 | (JP) . |
| 08238853 | 9/1996 | (JP) . |

*Primary Examiner*—Bruce H. Hess
(74) *Attorney, Agent, or Firm*—Killworth, Gottman, Hagan & Schaeff, L.L.P.

(57) ABSTRACT

A thermally imagable business record, such as a form, label, tag, or the like is provided which may be activated to form human and/or machine readable images as well as different colored images. The record comprises a substrate having a thermally imagable coating on substantially its entire surface which forms a first color when activated, and having a desensitized area on at least one area of its surface which may be overcoated with a thermally imagable coating capable of forming a different color upon activation than the first thermally imagable coating. The first thermally imagable coating provides images which are of machine readable quality, while the additional thermally imagable coatings provide images of a different color to designate selected areas on the form or label to a user.

5 Claims, 7 Drawing Sheets

U.S. PATENT DOCUMENTS

| | | |
|---|---|---|
| 4,662,651 | 5/1987 | Mowry, Jr. . |
| 4,663,641 | 5/1987 | Iiyama et al. . |
| 4,665,410 | 5/1987 | Iiyama et al. . |
| 4,814,319 | 3/1989 | Matsumoto et al. . |
| 4,818,742 | 4/1989 | Ellis . |
| 4,824,144 | 4/1989 | Tasma . |
| 4,833,122 | 5/1989 | Doll et al. . |
| 4,846,503 | 7/1989 | Strauss . |
| 4,851,383 | 7/1989 | Fickenscher et al. . |
| 4,855,277 | 8/1989 | Walter . |
| 4,861,748 | 8/1989 | Saeki et al. . |
| 4,861,749 | 8/1989 | Satake et al. . |
| 4,865,939 | 9/1989 | Usami et al. . |
| 4,894,359 | 1/1990 | Ueno et al. . |
| 4,898,849 | 2/1990 | Kang . |
| 4,918,046 | 4/1990 | Akutsu et al. . |
| 4,921,535 | 5/1990 | Nachbur et al. . |
| 4,962,079 | 10/1990 | Matsumoto et al. . |
| 4,981,835 | 1/1991 | Iwakura et al. . |
| 5,001,104 | 3/1991 | Morita et al. . |
| 5,039,652 | 8/1991 | Doll et al. . |
| 5,045,523 | 9/1991 | Funae et al. . |
| 5,083,816 | 1/1992 | Folga et al. . |
| 5,135,262 | 8/1992 | Smith et al. . |
| 5,209,515 | 5/1993 | Dotson et al. . |
| 5,282,651 | 2/1994 | Alonso . |
| 5,344,191 | 9/1994 | Chang . |
| 5,395,137 | 3/1995 | Kim . |
| 5,401,060 | 3/1995 | Chang et al. . |
| 5,427,415 | 6/1995 | Chang . |
| 5,524,934 | 6/1996 | Schwan et al. . |
| 5,618,063 | 4/1997 | Chang et al. . |
| 5,898,017 | 4/1999 | Chang . |

THERMALLY IMAGABLE BUSINESS RECORD AND METHOD OF DESENSITIZING A THERMALLY IMAGABLE SURFACE

CROSS REFERENCE TO RELATED APPLICATIONS

This application is a division of Ser. No. 094/061,454 Apr. 16, 1998 now U.S. Pat. No. 6,015,589 issue Jan. 18, 2000 which is a division of Ser. No. 08/794,476 Feb. 4, 1997, now U.S. Pat. No. 5,810,397 issued Sep. 22, 1998, which application is a continuation-in-part of commonly assigned U.S. patent application Ser. No. 08/235,543, filed Apr. 29, 1994, now U.S. Pat. No. 5,984,363 which is a continuation-in-part of U.S. application Ser. No. 08/055,576 filed May 3, 1993, which was abandoned in favor of U.S. application Ser. No. 08/312,424 filed Sep. 26, 1994, now issued as U.S. Pat. No. 5,524,934, both of which applications are hereby incorporated by reference.

BACKGROUND OF THE INVENTION

This invention relates to a thermally imagable business record, such as a form, label, tag, or the like, which may be activated to form multicolored images, and more particularly, to a substrate having a first thermally imagable coating on its surface which forms a first color when activated, and having a desensitized area and/or a masked area on at least one portion of its surface. The desensitized or masked area may be overcoated with an additional thermally imagable coating capable of forming a different color upon activation than the first thermally imagable coating.

Direct thermal printing has been a well-known means of non-impact printing. Direct thermal printers are capable of forming images by the application of heat to a substrate containing heat-reactive chemicals thereon. Typically, a substrate such as paper is coated with a thermally imagable coating of color forming and color developing reactants, which, when heated, combine and react to form a visible image. When the coated substrate passes under the print head of a thermal printer, the thermally imagable coating is activated by the heated print elements, forming images on the surface of the substrate.

Substrates coated with thermally imagable coatings provide a convenient method of printing computer generated data such as bar codes or serial numbers on business forms such as labels or tags.

For example, thermally imagable substrates have been widely used as facsimile paper, bar code paper for point-of-sale (POS) systems, automatic ticket vending machines, and labels for food products. There are various compositions and methods of applying thermally imagable coatings as described, for example, in U.S. Pat. Nos. 4,865,939, 4,861,749, and 4,894,359.

However, while the use of thermally imagable coatings is a convenient method of providing a printable surface, the present method of applying the coatings is to cover the entire surface of the substrate with a thermally imagable coating which forms a single color, typically black. In certain applications, it would be desirable to be able to print multicolored images on a substrate. For example, the use of different colored images may be used to differentiate categories of information on a form.

One method for providing multiple colored areas on a business record is by applying heat at different temperatures to a coated substrate. For example, Iiyama et al, U.S. Pat. No. 4,665,410, teach a multi-color thermosensitive recording material formed by applying three or more successively overlaid thermosensitive coloring layers to a support material with intermediate layers containing a decolorizing agent. Each coloring layer yields a different color depending on the quantity of thermal energy applied. However, separate printing passes with operation at different temperatures must be made for each selected color.

Another method for providing multiple colored areas on a business record is described in commonly assigned U.S. Pat. No. 5,524,934. In this method, two or more thermally imagable coatings which produce different colors are applied by flexographic printing techniques onto selected areas of a substrate. The substrate may be activated to form different colored images by printing in a single pass. However, for some applications, it may be desirable to be able to reserve an additional print tower in the flexographic equipment to print, for example, conventional inks onto the substrate.

It would also be desirable to be able to customize different grades of thermally coated substrates by providing multicolored areas in order to accommodate different end uses. For example, thermally imagable substrates may be designed to generate bar codes which may be scanned in the infra red, visible, or near infrared ranges. Other grades may be tailored to be activated by specific printers.

Accordingly, there is still a need in the art for a business form, label or the like having thermally imagable coatings thereon which can be printed using conventional flexographic printing techniques and which may be activated in a single pass through a thermal printer to produce different colored images.

SUMMARY OF THE INVENTION

The present invention meets that need by providing a business record such as a form, label, or tag having a thermally imagable coating over substantially its entire surface which may be activated to form a first color, and having a desensitizing composition and/or an opaque ink on at least one selected area of its surface. The desensitizing composition or opaque ink may be overcoated with at least one additional thermally imagable coating capable of producing a different color than the first thermally imagable coating. When activated by a thermal printer, the first thermally imagable coating produces a machine readable image of a single color, typically black, while the additional thermally imagable coating produces a different colored image on the record to delineate or designate information to a user. The presence of the desensitizing composition prevents the first thermally imagable coating beneath the additional thermally imagable coating from activating, while the presence of an opaque ink masks any color formed by the first thermally imagable coating.

In accordance with one aspect of the invention, a thermally imagable business record which may be activated to form multicolored images is provided comprising a substrate having first and second major surfaces. The first surface of the substrate has a first thermally imagable coating thereon which, when activated, produces a first color. Preferably, the first thermally imagable coating covers substantially the entire surface of the substrate. In addition, at least one selected area of the first surface, which area is less than the entire surface of the substrate, has a desensitizing composition thereon which overlies the first thermally imagable coating to form a desensitized area on the substrate. At least one additional thermally imagable coating overlies the desensitized area, which, when activated, produces a second color which is different from the first color.

The desensitizing composition is preferably applied as an aqueous-based ink which comprises from about 20 to 35% by weight water, 2 to 30% by weight of an amine-containing compound, from about 15 to 40% by weight of a binder, from about 15 to 25% by weight of a filler, from about 3 to 10% by weight wax, from about 1 to 7% by weight of a film former, and from about 0.2 to 1.0% of a surfactant. The desensitizing composition is preferably applied to yield a dry coating weight of from about 0.5 to 2 lb./ream (0.81 to 3.25 g/m$^2$) (24"×36", 500 sheet ream) Preferably, the desensitizing composition has a pH of from about 9 to 14 to optimize the desensitizing properties of the composition.

In one embodiment of the invention, the desensitizing composition is blended with an opaque ink. The opaque ink functions to help mask any color formed by the first thermally imagable coating on the substrate.

In one embodiment of the invention, the substrate is coated on only one selected area with the desensitizing composition and additional thermally imagable coating. However, additional areas may also be coated. For example, a plurality of selected areas of the substrate may be coated with the desensitizing composition, with a plurality of additional thermally imagable coatings overlying the areas coated with the desensitizing composition such that when the plurality of additional thermally imagable coatings are activated, a plurality of different colors are formed which are different than the first color. Generally, but not necessarily, the areas covered by the desensitizing composition and additional thermally imagable coatings are coextensive.

In a preferred embodiment of the invention, the thermally imagable business record further comprises a barrier coating on the selected area or areas of the first surface which contain the desensitizing composition. The barrier coating functions to seal the desensitized areas before application of any additional thermally imagable coatings. Preferably, the barrier coating comprises an acrylic binder or other water soluble resin binder, a crosslinking agent, and a wax emulsion.

In another embodiment of the invention, the thermally imagable business record comprises a series of labels on the substrate, where the substrate includes a series of desensitized areas and additional thermally imagable coatings as described above. In this embodiment, the second surface of the substrate is coated with an adhesive. The adhesive may be a permanent, removable, or repositionable pressure sensitive adhesive, a hot melt adhesive, an acrylic water-based adhesive, an ultraviolet-curable adhesive, or other suitable adhesive. A release liner is preferably adhered to the adhesive side of the substrate so that the series of labels may be easily fed through a thermal printer for imaging.

In yet another embodiment of the invention, the thermally imagable business record comprises a continuous web for producing a series of thermally imagable business forms such as labels, coupons, or tags. The continuous web preferably includes a series of desensitized areas which have additional thermally imagable coatings thereon.

The present invention also provides a method of making a thermally imagable business record which includes the steps of providing a substrate having first and second major surfaces which contains a first thermally imagable coating on its first surface, which when, activated, forms a first color. A desensitizing composition is applied to at least one selected area of the first surface of the substrate, followed by the application of at least one additional thermally imagable coating over the desensitized area of the substrate. The areas covered by the desensitizing composition and additional thermally imagable coating are preferably coextensive; however, the area covered by the desensitizing composition may extend beyond the thermally imagable coating.

In a preferred embodiment, the method includes the step of applying a barrier coating over the desensitized area prior to applying the additional thermally imagable coating.

In another embodiment, the desensitizing composition and additional thermally imagable coating may be printed on a series of areas on the substrate so as to form a series of labels. In this embodiment, the method preferably includes the steps of coating a pressure sensitive adhesive on the second surface of the substrate and adhering a release liner to the pressure sensitive adhesive.

In yet another embodiment, a linerless continuous series of labels may be provided in which a web is coated on its first surface with a release material which overlies the thermally imagable coating, desensitizing composition, and additional thermally imagable coating. The second surface of the web includes a coating of a pressure sensitive adhesive which allows the labels to be wound into a roll such that the coating of pressure sensitive adhesive on the second surface of the web contacts the release material on the first surface of the web to permit individual labels to be unwound and dispensed from the roll.

In an alternative embodiment of the invention, a thermally imagable business record is provided in which an opaque ink is coated on a selected area or areas of the substrate rather than the desensitizing composition. In this embodiment, the business record comprises a substrate having first and second major surfaces, where the first surface of the substrate has a thermally imagable coating thereon which, when activated, produces a first color. At least one selected area of the first surface, which area is less than the entire surface of the substrate, has an opaque ink thereon which overlies the thermally imagable coating to form an area on the substrate which masks any color formed by the first thermally imagable coating underneath. The thermally imagable business record may further include at least one additional thermally imagable coating overlying the masked area which, when activated, produces a second color which is different from the first color.

In yet another alternative embodiment of the invention, a thermally imagable business record is provided which may be coated with a desensitizing composition on one or more selected areas without providing any additional thermally imagable coatings. The business record comprises a substrate having first and second major surfaces, with the first surface of the substrate having a thermally imagable coating thereon which, when activated, produces a color and at least one selected area of the first surface which area is less than the entire surface of the substrate having a desensitizing composition thereon which overlies the thermally imagable coating to form a desensitized area on the substrate. In a preferred embodiment, the desensitizing composition is pattern coated on the substrate in the form of indicia which become visible upon activation of the thermally imagable coating.

Accordingly, it is a feature of the present invention to provide a thermally imagable business record such as a form, label, tag, or the like having a thermally imagable coating on its surface, which coating is desensitized and/or masked in a selected area and which may be overcoated with an additional thermally imagable coating such that machine readable and multicolor images may be formed when the coatings are activated with a thermal printer. Other features and advantages of the invention will be apparent from the following description, the accompanying drawings, and the appended claims.

DETAILED DESCRIPTION OF THE PREFERRED EMBODIMENTS

Figure 1:
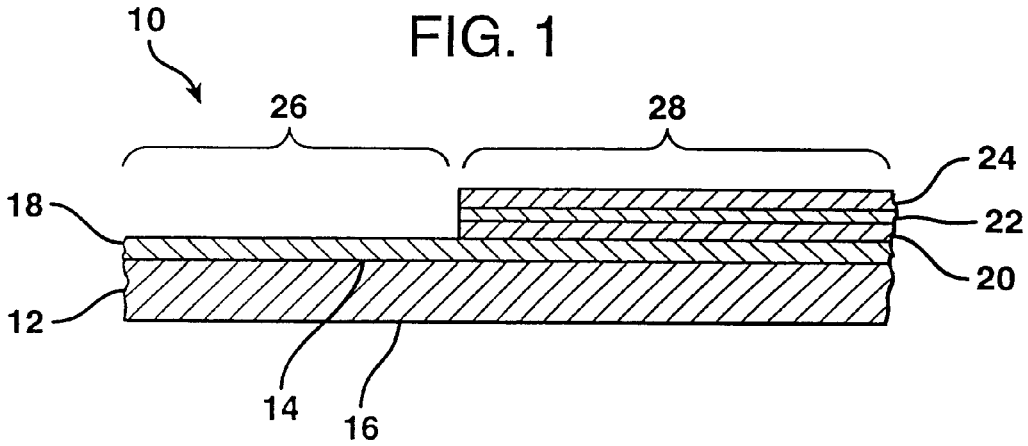
FIG. 1 is a fragmentary sectional view (not to scale) of a thermally imagable label in which a selected area has been desensitized and coated with an additional thermally imagable coating in accordance with the present invention.

The thermally imagable substrates which are desensitized and/or masked in accordance with the present invention are preferably comprised of direct thermal stock. Such stock typically comprises a paper or synthetic film substrate which has been coated over substantially its entire surface with a thermally imagable coating which forms a black color upon activation. Such direct thermal stocks are commercially available from Kanzaki Paper, Appleton Papers, Ricoh, or Fasson.

The desensitizing composition of the present invention as applied preferably comprises an aqueous-based ink having a pH of from about 9 to 14 which includes from about 20 to 35% by weight water, 2.5 to 30% by weight of an amine-containing compound, from about 15 to 40% by weight of a binder, from about 15 to 25% by weight of a filler, from about 3 to 10% by weight high density polyethylene wax, from about 1 to 7% of a film former, and from about 0.2 to 1.0% of a surfactant. Preferred amine-containing monomers or polymers (polyamines) for use in the desensitizing composition include monoethanolamine, diethylene triamine, tetrabutylammonium hydroxide, N-vinyl pyrrolidone or N-(aminoalkyl) lactam and its derivatives of epoxides, phenols, acrylonitrile and thiourea, all available from Aldrich Chemical Company. The monomers or polymers act as electron donors for the thermally imagable coating present on the substrate, and thus function to "neutralize" the properties of the thermally imagable coating to prevent coloration of the thermal stock.

The film former component functions as a carrier for the polyamine or amine-containing compound and preferably comprises a maleic anhydride copolymer. Suitable binders for use in the desensitizing composition include polyvinyl alcohol and acrylics. Suitable fillers include calcium carbonate and clay. A preferred wax is a high density polyethylene wax available from Michelman, Inc. under the designation EE 98040.

Suitable surfactants for use in the desensitizing composition include Tergitol 15-S-7, available from GAF Chemicals Union Carbide. The surfactant functions to provide a smooth coating and allows the composition to soak or wet-out the thermally imagable coating present on the substrate.

The desensitizing composition is preferably applied to the direct thermal stock by flexographic printing to produce a dry coating weight of from about 0.5 to 2 lb./ream (0.81 to 3.25 g/m$^2$) (24"×36", 500 sheet ream) although other conventional coating techniques may be utilized.

In embodiments where the desensitizing composition is applied to the substrate without the addition of a second thermally imagable overcoat, the composition is preferably printed as a pattern or as indicia, symbols, letters, or numbers. For example, the composition may be printed in the form of a logo on a label or ticket. When the thermally imagable coating on the substrate is activated by heat, the logo is formed as a reverse image on the label or ticket and may function as an authentication or security feature.

The desensitizing composition is preferably overcoated with a barrier coating which functions to seal the desensitized areas before application of the additional thermally imagable coating(s). The barrier coating may comprise an aqueous-based blend of starch binders, a polyvinyl alcohol binder, and a crosslinking agent for the polyvinyl alcohol binder, and is preferably applied by flexographic printing. A preferred barrier coating composition comprises from about 50 to 905 by weight of a starch binder, from about 5 to 20% by weight of a polyvinyl alcohol binder, and from about 0.2 to 1% of a crosslinker. A preferred polyvinyl alcohol binder is Anvol 205, available from Air Products. A preferred crosslinking agent for the polyvinyl alcohol binder is glyoxal (40%) available from Aldrich Chemical Company.

Suitable starch binders for use in the barrier coating are preferably formed from a blend of AQ0103 (a proprietary blend of solubilized modified starches available from Eviston Formulation Associates) and Pengloss XPG318 (a starch styrene/butadiene copolymer available from Penford Products Company).

In embodiments where an additional thermally imagable coating is applied over the desensitizing composition, the additional coating is preferably comprised of a color former and color developer. Suitable color formers for use in the present invention include colorless chromogenic dye precursors known in the art such as triphenyl methanes, diphenyl methanes, leuco dyes, xanthene compounds, thiazene compounds, and spiropyran compounds such as those described in U.S. Pat. No. 5,102,856, the disclosure of which is incorporated herein by reference.

Many different shades or hues of color may be produced on the document by combining color formers which form blue, yellow, green and red colors. Preferred for use in the present invention are leuco dyes prepared as dispersions in water containing 45 to 55% solids. Preferably, the color formers comprise from about 4 to 18% by weight of the coating formulation.

Suitable color developers include acidic color developers known in the art such as zinc salicylate, acetylated phenolic resins, salicylic acid modified phenolic resins, zincated phenolic resins, novolac type phenolic resins, and other monomolecular phenols such as bisphenol A, 4,4'- isopropylidene diphenol, 4,4'-sulfonyl diphenol, p,p' (1-methyl-n-hexylidene)diphenol, p-tert-butyl phenol, and p-phenyl phenol. A preferred color developer is bis(3-allyl-4-hydroxyphenyl) sulfone, which is prepared as a dispersion in water containing 45 to 55% solids. The color developer is preferably present in the thermally imagable coating formulation from about 15 to 30% by weight.

The additional thermally imagable coating also preferably contains from about 15 to 25% by weight of a sensitizer. The sensitizer is a low melting point solid which, when subjected to heat, melts and becomes a solvent for the color forming and developing reactants. Suitable sensitizers include B-naphthol benzyl ether, p-benzyl biphenyl, ethylene glycol-m-tolyl ether, m-Terphenyl, Bis [2(4-methoxy) phenoxy] ether, and dibenzyl oxalate.

A binder is also preferably included in the additional thermally imagable coating to improve the rheological properties of the coating for better printability and to promote good adhesion of the coating to the substrate surface. Suitable binders include starch, casein, polyvinyl alcohol, polyvinyl pyrrolidone, acrylamide/acrylate copolymers, carboxylated styrene butadiene latex, styrene acrylic latex, and mixtures thereof.

The additional thermally imagable coating or coatings are preferably applied to the business record substrate by flexographic, letterpress, or gravure printing techniques. However, any suitable coating or printing process may be used including direct gravure or screen processes. The thermally imagable coating is preferably applied to yield a dry coating weight of between about 0.50 and 2.50 lb./ream (1.9 to 9.4 g/m$^2$) (17"×22", 500 sheet ream), and may be selectively printed or coated on the surface of the substrate so that it overlies the desensitized area(s). The desensitizing composition and additional thermally imagable coatings can be applied with coating equipment in separate passes, or inline on coating equipment or on a flexographic press with multiple print stations.

In embodiments where the forms are to be passed through a thermal printer, it is preferable to apply a protective coating layer over the thermally imagable coatings in order to prevent build up of the thermal coating on the direct thermal print head. Suitable coatings which may be used for this purpose include blends of electron beam curable oligomers and monomers, crosslinkable, water-based film forming prepolymers, or blends of ultraviolet radiation curable oligomers and monomers and a photocatalyst. After application to the substrate, the coatings are then cured.

In embodiments where the desensitizing composition is blended with an opaque ink, the opaque ink preferably comprises an acrylic emulsion including titanium dioxide and calcium carbonate, a water soluble binder, and wetting and dispersing agents.

In embodiments where the opaque ink is used in place of the desensitizing composition, standard white or colored opaque flexographic inks are suitable for use. It is also within the scope of the invention to combine the color of the opaque ink with the latent color formed by the thermally imagable coating in order to achieve a different color upon activation. For example, printing a latent blue thermally imagable coating over a standard yellow opaque flexographic ink would result in a green image when activated.

With reference to the drawings, it must be appreciated that Patent Office requirements for solid black line drawings on a white surface make illustration of some of the subtleties of our invention relating to different colors difficult by the required Patent Office drawings alone. Reference to the following detailed description of the illustration will make full appreciation of the drawings and our invention possible.

Referring now to FIG. 1, a business record such as, for example, a label 10 is shown in cross-section comprising a substrate 12 having first and second surfaces 14 and 16, respectively. As shown in FIG. 1, substantially the entire first surface 14 of substrate 12 includes a thermally imagable coating 18 thereon which, when activated, forms a first color, typically black. Also as shown in FIG. 1, a selected area of the substrate has been coated with a desensitizing composition 20 which overlies a portion of thermally imagable coating 18. A barrier coating 22 has been coated over the desensitizing composition, and an additional thermally imagable coating 24 has been coated over the barrier coating. As shown, composition 20 and coatings 22 and 24 are coextensive. However, it should be appreciated that the desensitized area may also be somewhat larger than the area containing the thermally imagable coating. Thus, the thermally imagable label includes an area 26 where first thermally imagable coating 18 is exposed, and an area 28 where additional thermally imagable coating 24 is exposed.

Figure 2:
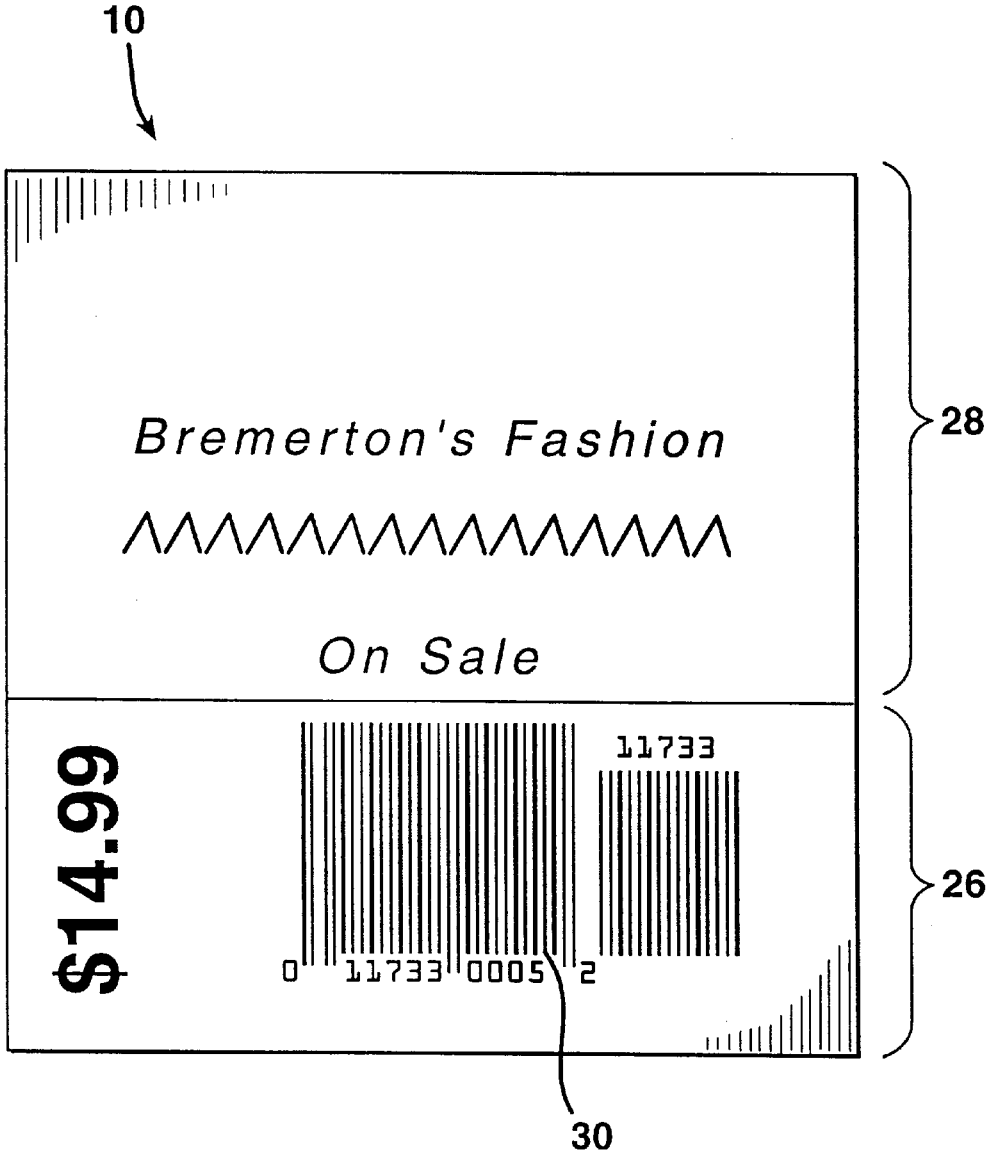
FIG. 2 is a front elevation view of the label of FIG. 1.

FIG. 2 illustrates the substrate of FIG. 1 after it has been passed through a thermal printer. As shown for purposes of illustration only, label 10 is a price sticker which may be adhered (by suitable means not shown) to articles for sale. As shown, area 26 has been imaged to provide a black, machine readable image such as, for example, bar code 30. The remaining area 28 has been imaged with the store name in a different color than area 26 (although such different color cannot be shown with black and white drawings).

While the drawings illustrate the imaging of machine-readable bar codes in area 26, it should be appreciated that the labels or forms of the present invention may also be printed with other unique indicium or symbols which are human and/or machine-readable in the visible or IR range such as a price ($14.99) as shown.

Figure 1A:
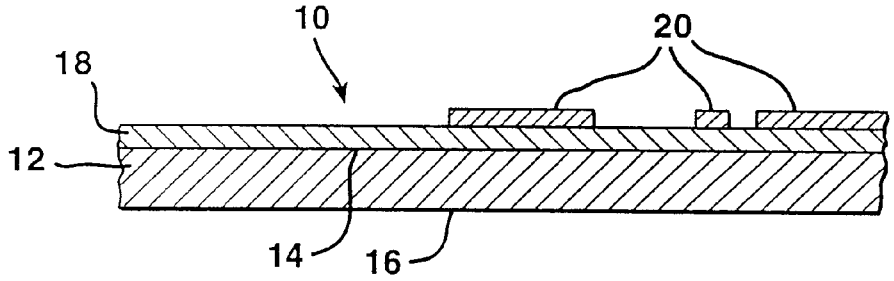
FIG. 1A is a fragmentary sectional view of a thermally imagable label which has coated with a desensitizing composition in a pattern.
Figure 2A:
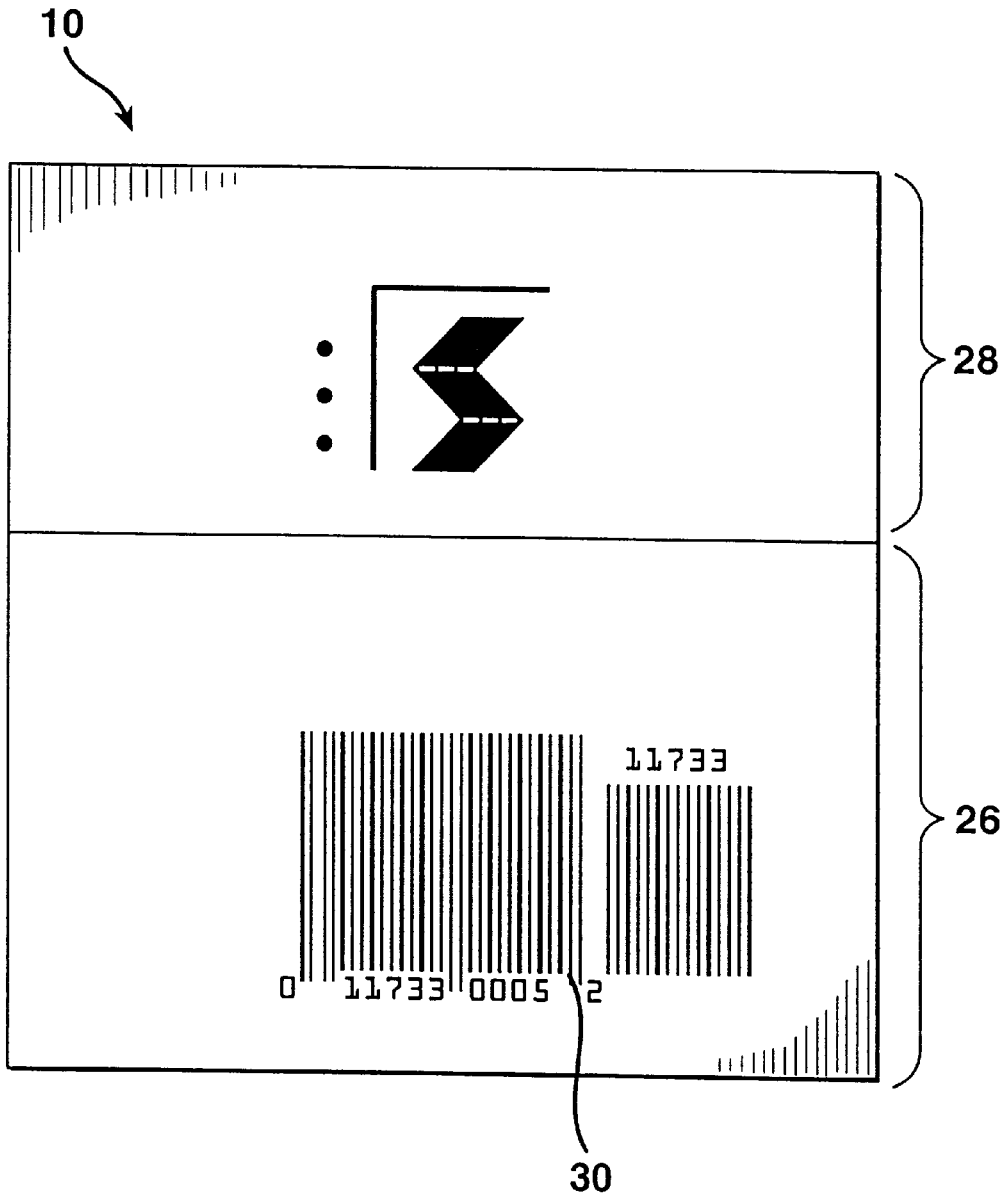
FIG. 2A is a front elevation view of the label of FIG. 1A.

Referring now to FIGS. 1A and 2A, an alternative embodiment for label 10 is shown in which substantially the entire first surface 14 of substrate 12 includes a thermally imagable coating 18 thereon, and a selected area of the substrate has been pattern coated with desensitizing composition 20 which overlies a portion of thermally imagable coating 18. As shown in FIG. 2A, when label 10 is imaged, it provides a black, machine readable image 30 in area 26. The area 28 containing the desensitizing composition has been imaged in reverse to form a logo in the same color as area 26.

Figure 1B:
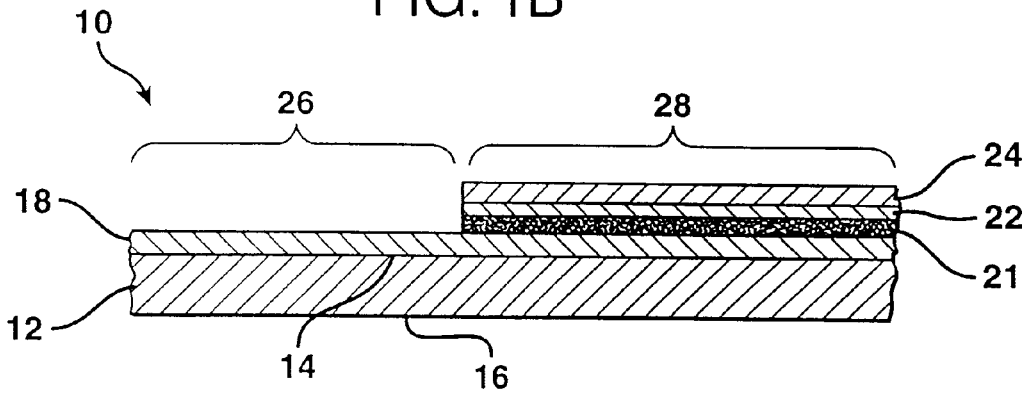
FIG. 1B is a fragmentary sectional view of a label in accordance with an alternative embodiment of the present invention.

FIG. 1B, where like reference numerals refer to like elements, illustrates another alternative embodiment in which a selected area of the substrate 12 has been coated with an opaque ink 21. Barrier coating 22 and additional thermally imagable coating 24 are applied over the opaque ink 12.

Figure 3:
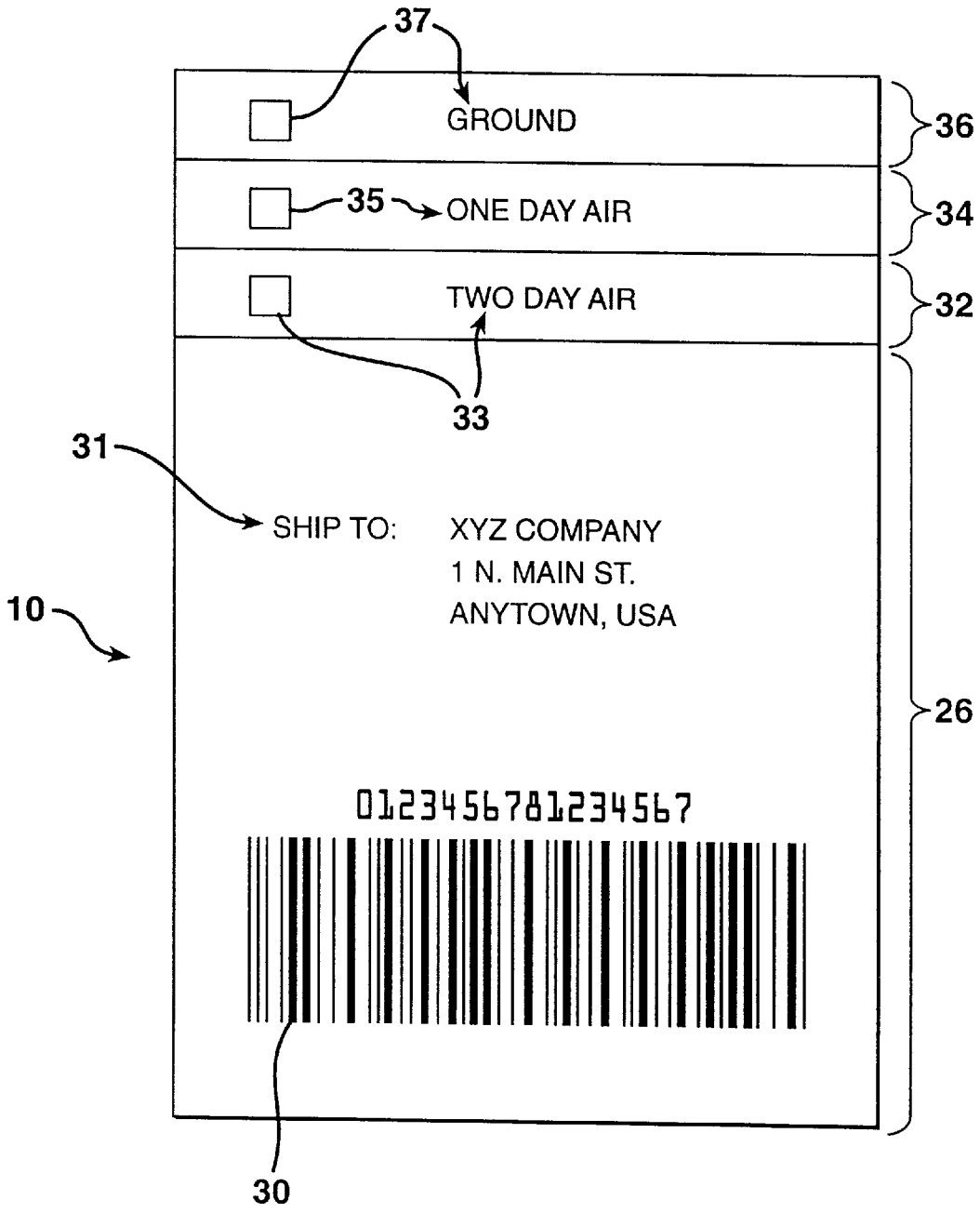
FIG. 3 is a front elevation view of a label in accordance with another embodiment of the invention.

In another embodiment of the invention illustrated in FIG. 3, a label 10 is provided in which a plurality of selected 10 areas of the thermally imagable substrate have been coated with a desensitizing composition and overcoated with different colored thermally imagable coatings. As shown, area 26 contains a thermally imagable coating which has been imaged to form a machine-readable bar code 30 and address information 31. Areas 32, 34 and 36 have each been coated with thermally imagable coatings which form different colors to help delineate the shipping methods designated on the label. For example, area 32 may be imaged to form images 33 of a red color, area 34 may be imaged to form images 35 of a blue color, and area 36 may be imaged to form images 37 of a yellow color.

It should be appreciated that many different combinations for placement of the desensitizing composition and/or opaque ink and additional thermally imagable coatings on a document are possible and are within the scope of this invention.

Figure 4:
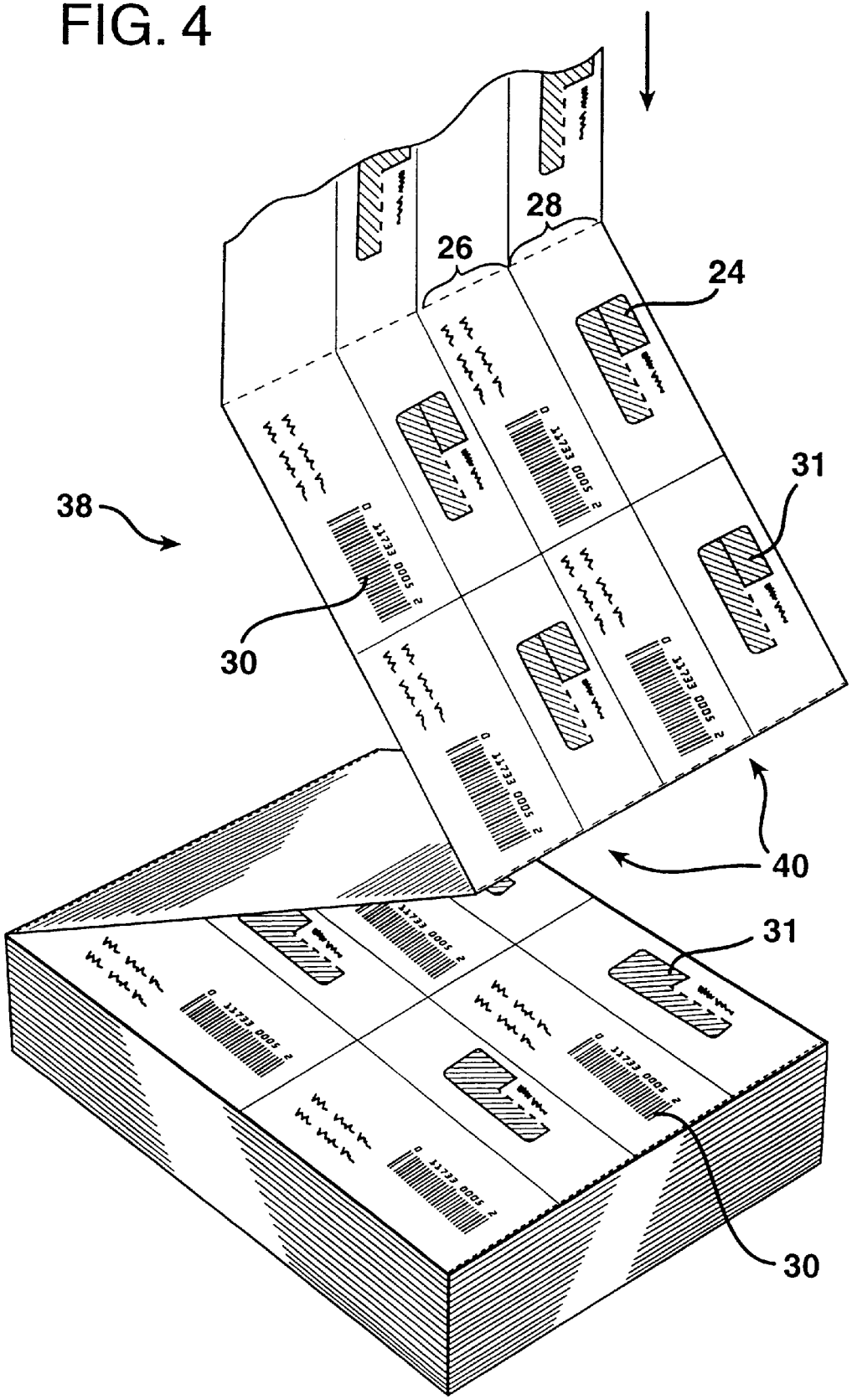
FIG. 4 is a perspective view of a continuous web of labels in accordance with another embodiment of the present invention.
Figure 4A:
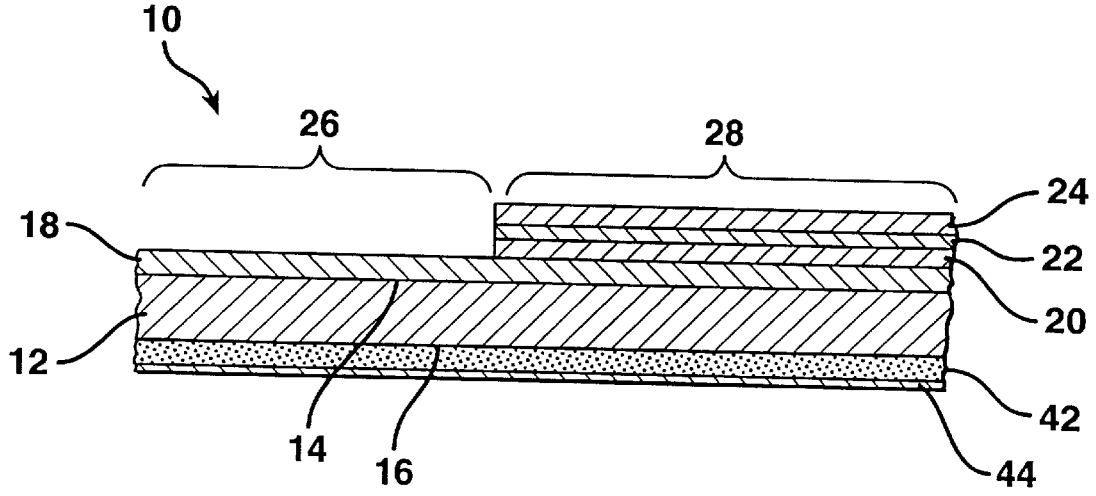
FIG. 4A is a fragmentary sectional view of another embodiment of the invention.

In yet another embodiment of the invention illustrated in FIGS. 4 and 4A, a continuous form 38 is shown which contains a series of labels 40 coated with a series of desensitized areas and overcoated with additional thermally imagable coatings 24. As shown, area 26 contains a thermally imagable coating and has been imaged to form a machine-readable bar code 30, while area 28 has been coated with a thermally imagable coating which forms an image 31 of a different color.

As shown in FIG. 4A, the web 12 of labels includes a pressure sensitive adhesive 42 on its second surface 16. The adhesive preferably comprises a pressure-sensitive adhesive but may include any suitable adhesive such as water-based, solvent-based or hot-melt adhesives. The adhesive may be permanent, removable, or repositionable. Where a pressure sensitive adhesive is used, a release liner 44 covers the adhesive and protects it until use.

Figure 5:
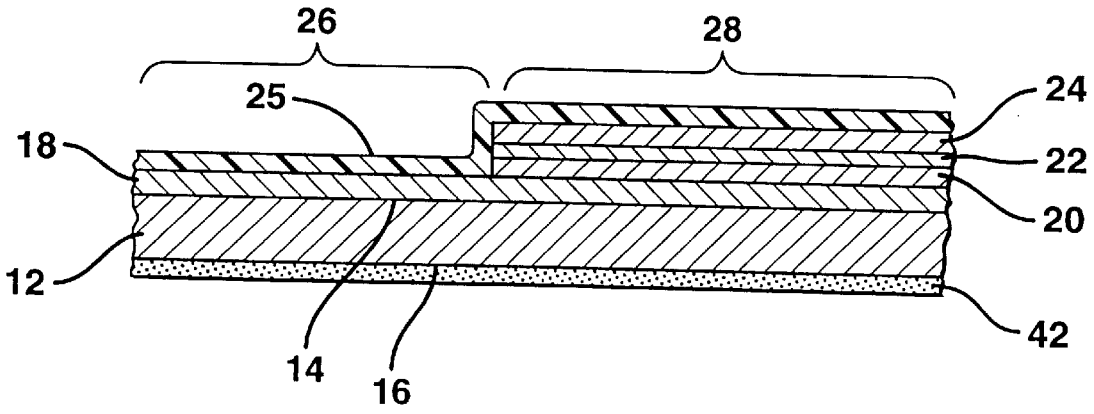
FIG. 5 is a sectional view of one label in a series illustrating another embodiment of the invention.
Figure 6:
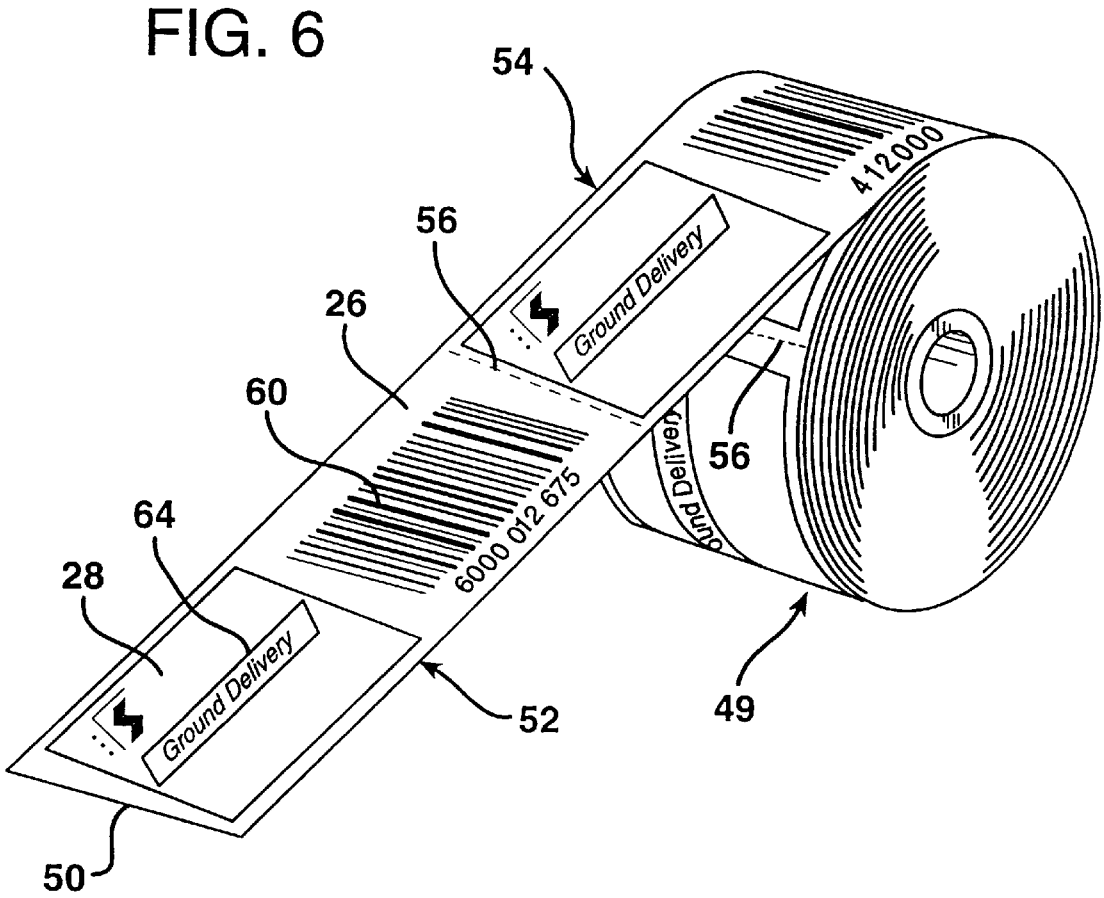
FIG. 6 is a perspective view of a roll of labels.

FIGS. 5 and 6 illustrate yet another embodiment of the invention in which a web of continuous linerless labels is provided in the form of a roll 49 comprising a web 50 having individual labels 52, 54. The individual labels may be unwound and severed from the roll along perforations 56. As shown in FIG. 5, each individual label in the web includes a release coating 25 on its first surface which overlies the thermally imagable coating 18, desensitizing composition 20, barrier coating 22, and thermally imagable coating 24. As shown, the web further includes a pressure sensitive adhesive 42 on its second surface 16.

As shown in FIG. 6, label 52 has an area 26 which has been imaged to form a machine-readable bar code 60, while area 28 has been coated with an additional thermally imagable coating which forms an image 64 of a different color.

The thermally imagable business record of the present invention provides the significant advantage that a document may be provided with a machine-readable image which can be read and recorded by automated equipment and at the same time provided with different colored human-readable or viewable images which draw the attention of the reader to designated areas on the form. In addition, the method is convenient and cost-effective because the coatings can be applied in-line and then activated by a single pass through a thermal printer.

In order that the invention may be more readily understood, reference is made to the following example which is intended to illustrate the invention, but not limit the scope thereof.

Example 1

The following materials were combined and blended by mild agitation to produce a desensitizing composition:

| | Weight % |
|---|---|
| water | 36.6 |
| polyamine[1] | 26.7 |
| polyvinyl alcohol (20%) | 22.9 |
| surfactant[2] | 0.3 |
| high density polyethylene wax[3] | 7.6 |
| filler[4] | 1.1 |
| Gantrez[5] | 4.8 |

[1]Aldrich Chemical
[2]Union Carbide
[3]Michelman, Inc.
[4]GAF Chemicals Corp.
[5]GAF Chemicals Corp.

The above formulation was applied by flexographic printing onto direct thermal stock (Kanzaki Paper). When the stock was passed through a thermal printer (Datamax DMX 600) the desensitizing coating was found to desensitize the stock in those areas which were coated with it so that those areas remained white (i.e., did not change color) and not imaged. The remainder of the thermally imagable stock was activated and produced a strong black color.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A document capable of providing multiple colors, comprising:

a substrate having at least one surface bearing a first coating comprising a thermally imagable coating capable of producing a first color;

a second coating covering a portion of said first coating, said second coating comprising an opaque ink; and a third coating covering said second coating comprising a thermally imagable coating capable of producing a second color, said first and second coatings being non-coextensive.

2. The document of claim 1 wherein said opaque ink comprises titanium dioxide.

3. The document of claim 1 wherein said document is a label.

4. The document of claim 1 wherein said first coating is coextensive with said substrate.

5. The document of claim 1 wherein said second and third coatings are substantially co-extensive.

* * * * *